United States Patent [19]

Drori

[11] 4,116,186

[45] Sep. 26, 1978

[54] FUEL INJECTION PUMPING APPARATUS

[75] Inventor: Moshe Drori, East Twickenham, England

[73] Assignee: CAV Limited, Birmingham, England

[21] Appl. No.: 808,131

[22] Filed: Jun. 20, 1977

[30] Foreign Application Priority Data

Jun. 22, 1976 [GB] United Kingdom ..... 25822/76

[51] Int. Cl.[2] ..... F02D 1/02

[52] U.S. Cl. ..... 123/139 AM; 123/140 FG; 417/251; 417/253; 417/294; 417/462

[58] Field of Search ..... 123/139 AK, 139 AL, 123/139 AQ, 139 AY, 139 AD, 139 AM, 140 R, 140 FG, 140 J; 417/244–253, 293, 294, 462

[56] References Cited

U.S. PATENT DOCUMENTS 4,041,920 8/1977 Skinner ..... 123/139 AM

*Primary Examiner*—Charles J. Myhre
*Assistant Examiner*—Tony M. Argenbright

[57] ABSTRACT

A fuel injection pumping apparatus includes an axially movable member which at one end is acted upon by governor weights and at its other end is acted upon by a spring, the governor weights moving the member in opposition to the spring, the reaction member for the weights comprising a dash-pot containing a further spring and the member being provided with a groove which can register with a port to control the flow of fuel delivered by the pumping apparatus to the associated engine. Also provided on the member is a further groove which is in restricted communication with the groove and which during certain conditions of rapid deceleration of the engine, is brought into communication with the port so as to ensure that under such conditions a restricted flow of fuel takes place to the engine.

2 Claims, 6 Drawing Figures

FUEL INJECTION PUMPING APPARATUS

This invention relates to fuel injection pumping apparatus for supplying fuel to internal combustion engines and of the kind comprising an injection pump, a feed pump for supplying fuel under pressure to the injection pump, an axially movable member disposed in a surrounding body, an adjustable orifice defined by a groove in the member and a port in the body, the size of said orifice determining the amount of fuel supplied to the engine at each injection stroke by the injection pump, a pivotal centrifugal weight acting on one end of the member and urging the member in an axial direction to reduce the size of said orifice, a governor spring acting to urge the member against the action of said weight, operator adjustable means for varying the force exerted by the spring, a reaction member for the pivot of said weight, resilient means acting to urge the reaction member and pivot in opposition to said governor spring and a dash-pot acting to limit the rate of movement of the reaction member against the action of said resilient means when the force exerted by the governor spring is increased, the arrangement being such that the weight, spring and orifice constitute a governor to control the speed of the associated engine in accordance with the setting of the operator adjustable means.

An apparatus of the kind set forth is described in U.S. Pat. No. 4,041,920, granted to Skinner on Aug. 16, 1977 and commonly assigned herewith. The purpose of the dash-pot is to limit the rate of increase in the size of the orifice constituted by the port and groove as the operator adjustable member is moved to increase the supply of fuel to the engine at least when the engine is accelerated from a low speed. It has been discovered however that the presence of the dash-pot and the resilient means can influence the operation of the associated engine in other operating conditions and in fact stalling of the associated engine can occur if the engine is accelerated from a steady idling speed to high speed and immediately returned to the idling speed. During such action there is not sufficient time for the dash-pot to collapse under the increased force exerted by the governor spring and as a result when the force exerted by the governor spring is reduced, the aforesaid orifice is closed and is not opened because of the tendency for the governor weight to lag before it closes in as the engine speed reduces, until the speed of the engine has fallen to a point at which the engine stalls. The effect is not so pronounced if the engine is allowed to return to the idling speed after it has been running at a high speed for a time sufficient to compress the dash-pot.

The object of the present invention is to provide an apparatus of the kind specified in a form in which stalling of the engine as described above, is minimised.

According to the invention in an apparatus of the kind specified a further groove is provided on the aforesaid member, said further groove being spaced from said first mentioned groove, said further groove being brought into registration with said port when the aforesaid orifice is closed during engine deceleration, said further groove being in restricted communication with said first mentioned groove so that a restricted supply of fuel can be supplied to the engine when said orifice is closed during conditions of engine deceleration.

One example of a fuel pumping apparatus in accordance with the invention will now be described with reference to the accompanying drawings in which.

Figure 1:
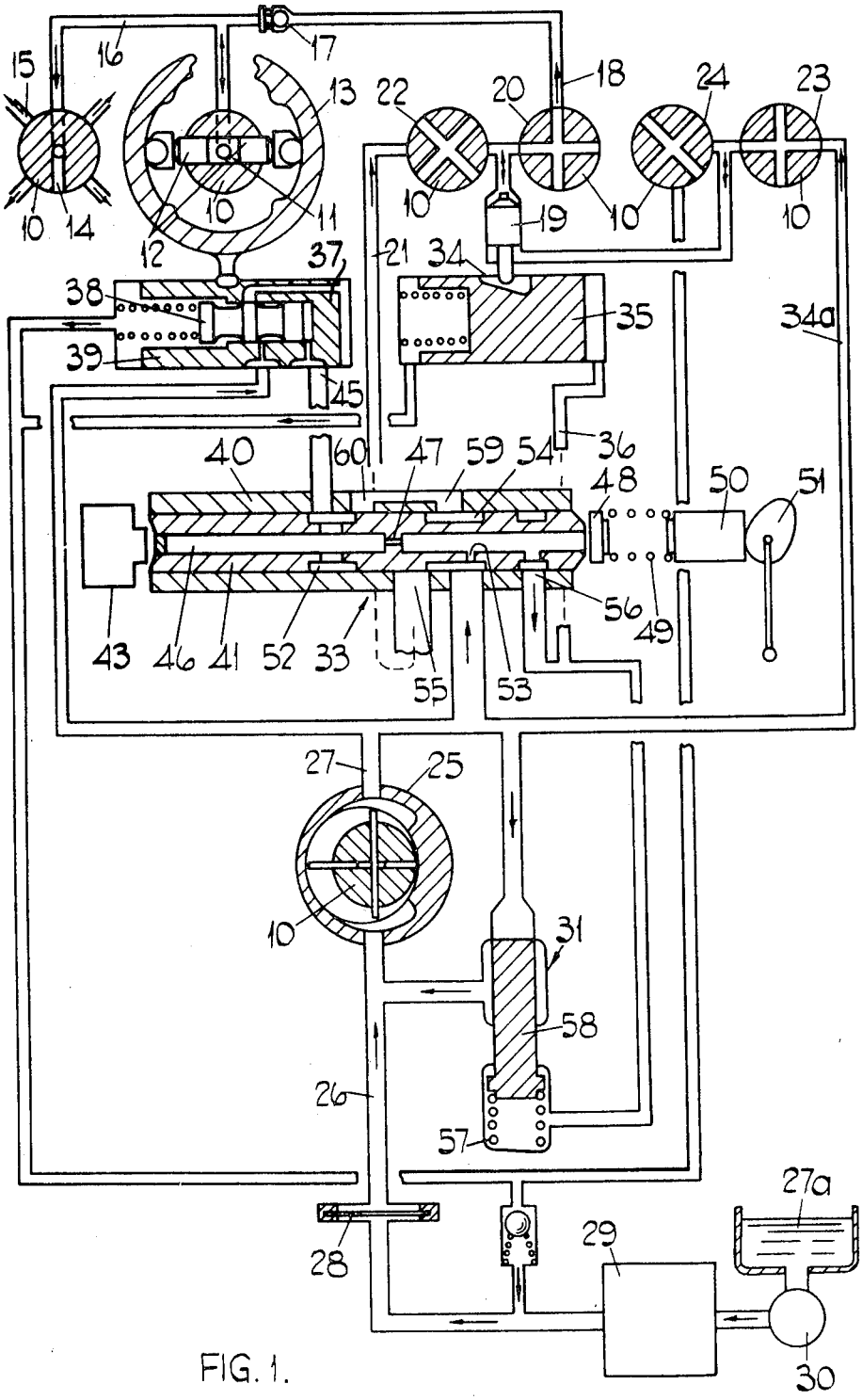
FIG. 1 is a diagrammatic illustration of the fuel circuits of the apparatus.

Referring to FIG. 1 of the drawings the apparatus comprises a body part in which located a rotary cylindrical distrubutor member 10 this being shown divided into seven parts. The distributor member is driven in timed relationship with the engine with which the apparatus is associated and at one point there is formed in the distributor member a transversely extending bore 11 in which is mounted a pair of reciprocable pumping plungers 12. Moreover, an annular cam ring 13 surrounds the distributor member and has its internal periphery, a plurality of pairs of diametrically disposed cam lobes. The cam lobes through the intermediary of rollers respectively act upon rotation of the distrubutor member, to move the pumping plungers 12 inwardly to displace fuel contained within the transverse bore 11. The pumping plungers 12 together with the cam lobes constitute an injection pump.

The bore 11 communicates with a passage 16 extending within the distributor member and at one point this passage communicates with an outwardly extending delivery passage 14 which is arranged to register in turn as the distributor member rotates, with a plurality of outlet ports 15 formed in the body part and which in use are connected to the injection nozzles respectively of the associated engine.

The passage 16 is in communication by way of check valve 17 with a passage 18 and this passage can be brought into communication with one end of a bore containing a slidable shuttle 19 by means of a rotary valve 20. The aforesaid one end of the bore at other times as will be explained, can be placed in communication with a feed passage 21 by means of a rotary valve 22.

The other end of the bore containing the shuttle can be placed in communication with a supply of liquid fuel under pressure by means of a rotary valve 23, or with a source of fuel at a low pressure by means of a rotary valve 24. The valves 20, 22, 23 and 24 are formed in or on the distributor member 10 and are therefore driven in timed relationship with the associated engine. In addition also mounted on the distributor member is a feed pump 25 of the rotary vane type and having an inlet 26 and an outlet 27. The inlet 26 communicates with a supply of fuel **27*a* by means of a pair of filter units 28, 29 and a lift pump 30 is provided to ensure the supply of fuel to the feed pump. The output pressure of the feed pump is controlled by the relief valve 31 the function of which will be described later. The outlet 27 of the feed pump communicates by way of passage 34*a* with the valve 23** and the feed pump therefore constitutes the source of fuel under pressure.

In operation, with the parts of the apparatus in the positions shown in FIG. 1 fuel is flowing from the outlet of the feed pump by way of the valve 23 to said other end of the bore containing the shuttle 19 and the shuttle 19 is being moved inwardly towards said one end of the bore. Fuel is therefore displaced from this end of the bore and flows by way of the rotary valve 20 and the check valve 17, to the passage 16 and the bore 11. The plungers 12 are therefore moved outwardly by an amount dependent upon the quantity of fuel displaced by the shuttle. During continued rotation of the distributor member the passage 14 is brought into register with an outlet port 15 and during this time the plungers 12 are moved inwardly so that fuel is displaced from the bore 11 to the appropriate engine cylinder. Also during this time the rotary valves 20 and 23 are closed and the valves 22 and 24 are open so that fuel now flows to said one end of the bore containing the shuttle 19 and this is therefore moved outwardly towards the other end of the bore. The quantity of fuel which is supplied to the bore containing the shuttle is controlled by a metering valve 33 which will be described, and this therefore determines the quantity of fuel which is supplied to the injection pump during a filling stroke and thereby the quantity of fuel which is supplied to the associated engine during an injection stroke. During continued rotation of the distrubutor member, the process described is repeated and fuel is supplied to the engine cylinders in turn.

It will be appreciated that the shuttle 19 determines the maximum quantity of fuel which can be supplied by the apparatus at each injection stroke. This maximum quantity of fuel is varied in accordance with the speed of the engine to provide shaping of the maximum fuel characteristic and for this purpose the maximum excersion of the shuttle is made to vary in accordance with the speed of the engine. The shuttle 19 is provided with an extended end portion which can co-operate with a cam surface formed on a spring loaded piston 35. The piston is moved against the action of its spring by fuel under pressure supplied to one end of the cylinder by way of a passage 36 and the pressure of fuel supplied is dependent upon the speed at which the apparatus is driven. The derivation of this fuel pressure will be described later. The effect therefore is that the axial setting of the piston 35 is dependent upon the speed of the associated engine and so the allowed excersion of the shuttle 19 will similarly be dependent upon the engine speed.

Also provided is a fluid pressure operable piston 39 which is connected to the cam ring 13 by means of a peg. The piston 39 is provided with a bore in which is located a spring loaded servo-valve 38 and the servo-valve is arranged to control the admission or escape of fuel under pressure from one end of the cylinder containing the piston 39. The fuel under pressure is obtained from the outlet of the feedpump and the servo-valve itself is subjected to the pressure existing in a conduit 45. As this pressure increases the servo-valve 38 will be moved against the action of its spring loading towards the left as seen in FIG. 1 and the piston 37 will follow this movement thereby moving the cam ring 13 angularly and varying the timing of injection of fuel to the engine.

Considering now the metering valve 33. This comprises a sleeve 40 fixed within the body part of the apparatus and mounting an axially movable body member 41 which at one end is acted upon by a weight mechanism 43 which will be described in greater detail with reference to FIGS. 2 and 3. Extending axially within the rod member is a bore 46 which at one end is closed by a plug and which intermediate its end incorporates a restrictor 47. At its opposite ends the bore 46 is obturated by a valve member 48 the latter being loaded by means of a coiled compression spring 49. The force exerted by the compression spring 49 is adjustable by moving an abutment 50 by means of an operator adjustable cam 51. The portion of the bore 46 which is closed by the plug is in constant communication with the conduit 45 this being by way of a circumferential groove 52 formed on the rod member. The groove 52 is in constant communication with a port formed in the sleeve 40 and communicating with the conduit 45. The other end of the passage 46 communicates by way of a restricted orifice 53, with a further circumferential groove 54 formed on the rod member. Moreover, formed in the sleeve is a port 55 which is in communication with the passage 21. The port 55 is positioned so that the groove can have partial registration therewith so as to define an adjustable orifice through which fuel can flow for supply to the injection pump. The groove 55 is in constant communication with the outlet of the feed pump.

The right hand end of the bore 46 is in constant communication by way of a further circumferential groove and a port 56, with the passage 36 which communicates with one end of the cylinder containing the piston 35. In addition the port 56 is in communication with the chamber which contains the spring 57 loading the valve member 58 of the relief valve. The spring 57 urges the valve member 58 towards the closed position in which no fuel is spilled from the outlet of the feed pump. Finally there is formed in the sleeve a pair of spaced and communicating ports 59, 60. The port 59 is in constant communication with the groove 54 and the port 60 can register with the circumferential groove 52 by an amount varying in accordance with the axial setting of the rod member 41. The port 60 and circumferential groove therefore constitute a further restricted orifice.

In operation the axial setting of the rod 41 is dependent upon the speed at which the engine is driven and as the engine speed increases the weights in the weight mechanism 43 will effect movement of the rod member towards the right as seen in FIG. 1. This movement takes place against the action of the spring 49. As explained the force exerted by the spring can be varied and if the spring force is increased then for a given engine speed the rod member will move towards the left against the action of the weights. As a result of such movement the effective size of the orifice constituted by the groove 54 and the port 55 will be increased so that more fuel will be supplied to the engine. The fuel pressure existing in the right hand end of the bore 46 is by virtue of the restrictor 53 and the valve member 48 proportional to the square of the speed at which the engine is driven. In practice, valve member 48 will be lifted slightly from the end of the passage 46 so that flow of fuel will occur from the restrictor 53.

The pressure in the right hand end of the passage 46 is allowed to act upon the valve member 58 of the relief valve and in so doing it supplements the force exerted by the spring 57. The output pressure of the feed pump will therefore have a value which is represented by the law $N^2 + K$ where N is the speed at which the apparatus is driven and K is a constant dependent upon the spring. The weights together with the orifice defined by the port 55 and the groove 54 and the spring 49 constitute a governor which controls the speed of operation of the engine.

With the arrangement described if the operator should suddenly effect an increase in the force exerted by the spring 49 then the rod member will immediately move to the left to cause a rapid increase in the amount of fuel supplied to the engine. At low engine speeds this can cause problems by temporarily overfuelling the engine whereas at higher speeds this problem tends not to arise.

Figure 2:
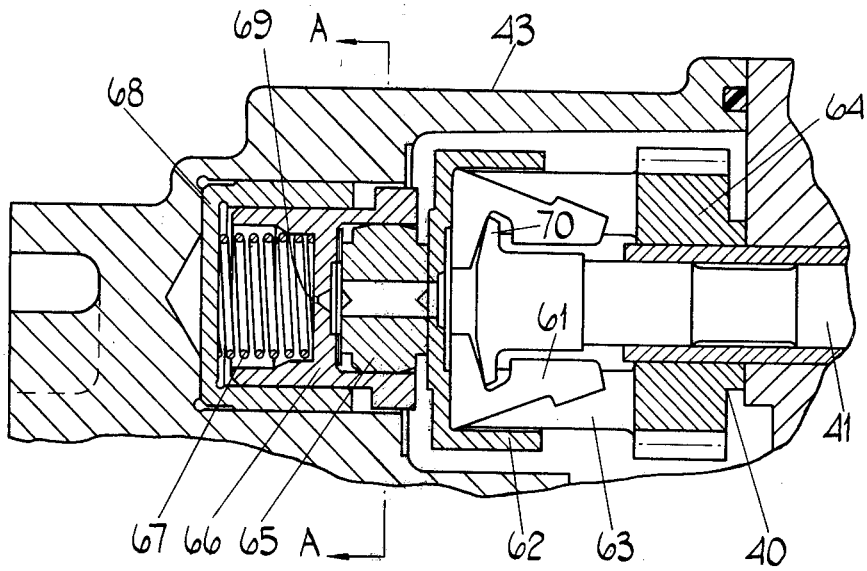
FIG. 2 is a sectional side elevation of a portion of the apparatus seen in outline only in FIG. 1.
Figure 3:
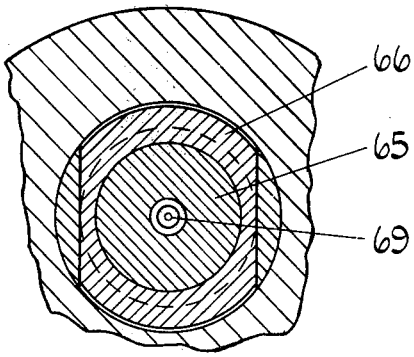
FIG. 3 is a section on the line AA of FIG. 2 and FIGS. 4, 5 and 6 show in outline only part of the apparatus which is seen in diagrammatic form in FIG. 1 and in three alternative positions.

Turning now to FIGS. 2 and 3 the construction of the weight mechanism 43 is shown in greater detail and it will be seen that the rod member 41 is provided with an outwardly extending flange 70 against which the toe portions of the weights 61 engage. The heel portions of the weights pivot against a surface defined in a cage 62 which is of generally cup-shaped form but which has extended portions 63 connected to a gear wheel 64 conveniently coupled by gearing to the distributor member 10 so that the cage rotates at a speed proportional to the engine speed.

The cage 62 constitutes a reaction member for the weights and engages a thrust member 65 which is itself accommodated within a recess formed in an axially movable spring abutment 66. The abutment 66 defines a recess for a further spring 67 the other end of the spring being located against the base wall of a cup-shaped member 68 secured within the body part of the apparatus. The abutment 66 and cup-shaped member 68 define a dash-pot and it will be noted that the abutment 66 is provided with a restricted aperture 69 which can restrict the rate of flow of liquid out of the dash-pot. It will be noted that the thrust member 65 is provided with a central aperture and that the end faces of the thrust member are notched to allow fuel to flow into and out of the dash-pot.

The strength of the coiled compression spring 67 is such that in the particular example, at low engine speeds i.e., up to above 400 r.p.m., the force exerted by the spring 67 is greater than that which is developed by the spring 49 when the engine is running with the governor in a position of equilibrium. As a result the cage member 62 is moved its maximum extent towards the right and assumes the position in which it is shown in FIG. 2. Moreover, in this equilibrium position the weights will have moved outwardly a small extent from the position in which they are shown in FIG. 2. If now the operator moves the throttle pedal of the vehicle so as to obtain maximum speed the immediate effects will be to increase the force exerted by the spring 49 and this in turn will cause axial movement of the rod member 41 so that the weights will be moved to the position in which they are shown in FIG. 2. In this position axial movement of the rod member is temporarily halted but with the throttle pedal fully depressed, the force exerted by the spring 49 is greater than that of the spring 67 so that a gradual collapse of the dash-pot will occur. During such collapse the rod member 41 will move under the action of the spring 49 and there will be a progressive increase in the amount of fuel supplied to the engine until the normal governing action takes place. The rate of increase of fuel will depend upon the size of the orifice 69 in relation to the displacement of the dash-pot and this can be chosen to give the required rate moreover, it will be understood that the strength of the spring 67 can be such so that the dash-pot action as described takes place up to any speed of the engine. As the dash-pot collapses the rod member 41 moves gradually towards the left thereby gradually increasing the fuel supply to the engine.

At increased engine speeds with the governor in a position of equilibrium the force exerted by the governer spring 49 will be greater than the force exerted by the spring 67 and as a result the dash-pot will in fact be permanently collapsed and therefore any increase in the force exerted by the governor spring will effect substantially immediate collapse of the governor weights towards the position shown in FIG. 2 and immediate increase in the quantity of fuel supplied to the engine.

Figure 4:
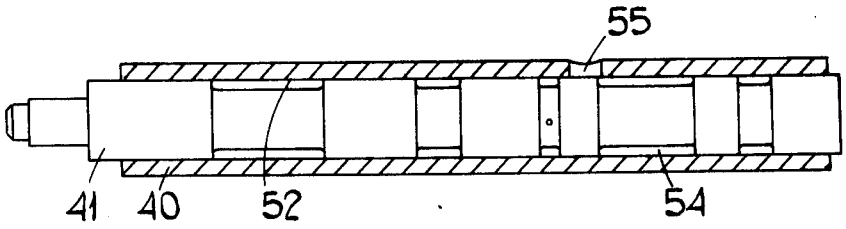
Figure 5:
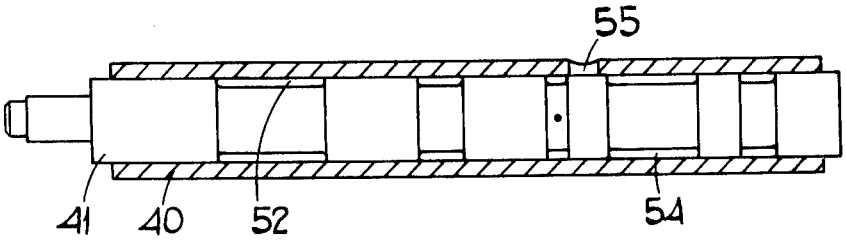

The provision of the dash-pot can however lead to undesirable effects when the engine is rapidly accelerated and decelerated. An attempt will be made to describe what happens with reference to FIGS. 4, 5 and 6. FIG. 4 shows the position of the sleeve 40 and rod member 41 corresponding to FIG. 1 and it will be seen that the orifice defined by the groove 54 and port 55 is comparatively small so that this represents the idling position. When the engine is accelerated this orifice will increase in size and if the engine is maintained at a high speed for a length of time sufficient for the dash-pot to collapse, then when it is decelerated the rod member and sleeve will temporarily assume the position shown in FIG. 5. In this position the orifice is completely closed because the governor weights 61 are fully open but the dash-pot is in a collapsed state as the speed falls the weights will gradually move inwardly and the orifice will open before the engine reaches its idling speed so that fuel will start to be supplied to the engine as it falls towards its idling speed. As the engine speed falls the dash-pot will gradually extend but this movement can be compensated for by the weights.

Figure 6:
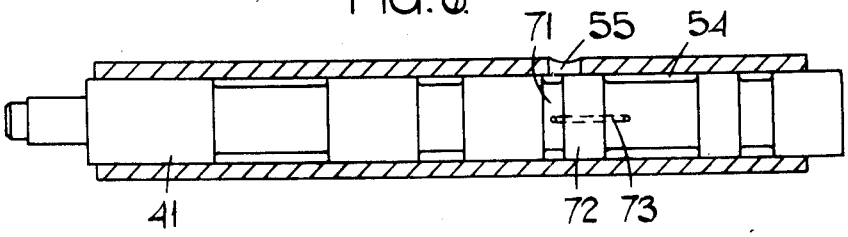

Turning now to FIG. 6 this shows the situation which can arise with the apparatus so far described and when from idling speed, the engine is allowed to accelerate quickly and immediately decelerated. In this situation the dash-pot will not have had time to collapse and because the weights cannot move quickly in response to changes in engine speed, the rod member 41 will move further towards the right as compared with the situation shown in FIG. 5 and it may not recover under the action of the weights before the engine speed has fallen below the stalling speed.

Once the engine has reached its stalling speed then even if the orifice is reopened, it cannot recover and therefore stops.

In order to overcome this difficulty a further circumferential groove 71 is formed on the rod member spaced from the groove 54 by a land 72 the width of which is only slightly greater than the width of the port 55. The groove 71 is in communication with the groove 54 by way of a drilling 73 constituting a fixed restriction. As will be seen from FIG. 6, when the rod member 41 assumes its extreme right hand position the groove 71 is brought into register with the port 55 so that a supply of fuel takes place to the engine during its deceleration. This supply of fuel does of course reduce the rate of deceleration of the engine and the position of the further circumferential groove 71 together with the size of the restricted drilling 73 connecting it with the groove 54, must be carefully chosen so as to impare the deceleration and over-run operating conditions of the engine as little as possible.

In a practical example it was found that the best results were obtained if the axial length of the land 72 was 3.5 m.m. and with a restricted passage of 0.3 m.m. diameter.

I claim:

1. A fuel injection pumping apparatus for supplying fuel to internal combustion engines and of the kind comprising an injection pump, a feed pump for supplying fuel under pressure to the injection pump, an axially movable member disposed in a surrounding body, an adjustable orifice defined by a groove in the member and a port in the body, the size of said orifice determining the amount of fuel supplied to the engine at each injection stroke by the injection pump, a pivotal centrifugal weight acting on one end of the member and urging the member in an axial direction to reduce the size of said orifice, a governor spring acting to urge the member against the action of said weight, operator adjustable means for varying the force exerted by the spring, a reaction member for the pivot of said weight, resilient means acting to urge the reaction member and pivot in opposition to said governor spring and a dashpot acting to limit the rate of movement of the reaction member against the action of said resilient means when the force exerted by the governor spring is increased, said weight, spring and orifice constitute a governor to control the speed of the associated engine in accordance with the setting of the operator adjustable means, characterised in that a further groove is provided on the aforesaid member, said further groove being spaced from said first mentioned groove, said further groove being brought into registration with said port when the aforesaid orifice is closed during engine deceleration, said further groove being in restricted communication with said first mentioned groove so that a restricted supply of fuel can be supplied to the engine when said orifice is closed, during conditions of engine deceleration.

2. An apparatus according to claim 1 characterised by a drilling formed in said axially movable member, said drilling extending between said grooves and providing the restricted communication between the grooves.

* * * * *